US006583731B2

(12) United States Patent
Chan et al.

(10) Patent No.: US 6,583,731 B2
(45) Date of Patent: Jun. 24, 2003

(54) FAULT DETECTION FOR TRAFFIC LIGHT SYSTEMS USING ELECTRONIC LIGHTING ELEMENTS

(75) Inventors: Hua Tek Chan, Singapore (SG); Tai Leong Cheng, Singapore (SG); Muthuraman Ramaswamy, Singapore (SG)

(73) Assignee: Singapore Technologies Electronics Ltd., Singapore (SG)

( * ) Notice: Subject to any disclaimer, the term of this patent is extended or adjusted under 35 U.S.C. 154(b) by 148 days.

(21) Appl. No.: 09/839,805

(22) Filed: Apr. 19, 2001

(65) Prior Publication Data

US 2002/0154031 A1 Oct. 24, 2002

(51) Int. Cl.[7] ..... G08G 1/097

(52) U.S. Cl. ..... 340/931; 340/331; 340/642; 340/691.8; 340/815.45

(58) Field of Search ..... 340/931, 331–332, 340/691.8, 691.4, 641, 642, 664, 815.45

(56) References Cited

U.S. PATENT DOCUMENTS 4,383,240 A * 5/1983 Staats, Jr. ..... 340/931
5,248,967 A * 9/1993 Daneshfar ..... 340/931
5,327,123 A * 7/1994 Heimann et al. ..... 340/931 X
5,387,909 A * 2/1995 Neel et al. ..... 340/931
5,457,450 A * 10/1995 Deese et al. ..... 340/931 X
6,184,799 B1 * 2/2001 Jinno et al. ..... 340/931 X

FOREIGN PATENT DOCUMENTS

GB 2135540 A * 8/1984

OTHER PUBLICATIONS

English–language Abstract of French publication 2724749 A1 (Mar. 22, 1996), Derwent Acc. No. 1996–181513.*

* cited by examiner

*Primary Examiner*—Thomas Mullen
(74) *Attorney, Agent, or Firm*—Lawrence Y.D. Ho & Assoc's.

(57) ABSTRACT

An indicator controller (18), an optical assembly (10) having the indicator controller (10), a traffic light system that comprises at least one of the optical assembly (10) and a method for fault indication by the indicator controller (10) is disclosed. A control signal from a control signal generator (20) of the indicator controller (18) is disabled to block off current supply to a diode chain of three light emitting diodes (LEDs) of an array (12) of LEDs. Input to the control signal generator (20) has a frequency setting section that sets the control signal at a predetermined frequency. Consequently, the three LEDs are made to blink according to the predetermined frequency. The control signal is generated when the amplitude of current supply to the array (12) exceeds a threshold setting.

4 Claims, 3 Drawing Sheets

FAULT DETECTION FOR TRAFFIC LIGHT SYSTEMS USING ELECTRONIC LIGHTING ELEMENTS

FIELD OF THE INVENTION

The present invention relates to traffic light systems. In particular, this invention relates to fault detection in traffic lights systems that use electronic lighting elements such as light emitting diodes (LEDs) to provide light signals at desired colors.

BACKGROUND OF THE INVENTION

A common fault detection technique applied in existing traffic light systems is to determine power consumption of traffic lights. Typically, the power consumption is determined by monitoring the current drawn by the traffic lights. Hence, when the current supplied drops below a predetermined value, control circuits for such traffic light systems generate alert signals to indicate a fault.

However, monitoring the current drawn at the system level is a problem because of inaccuracies. For example, leakage currents in cables or wires that supply power to the traffic light systems can lead to incorrect current measurements. Also, poor electrical contact between lighting elements of a traffic light system and power supply cables or wires causes the current to be supplied intermittently. Hence, such poor electrical contact leads to inaccurate fault detection.

Furthermore, in traffic light systems that use incandescent lamps or halogen bulbs, an alert signal does not provide a clear indication of which lamp or bulb is malfunctioning. In these traffic light systems, additional time and effort is required to trace a fault and this is unproductive for maintenance.

As is known, electronic lighting elements such as light emitting diodes (LEDs) have better durability compared with electrical lighting elements such as incandescent lamps and halogen bulbs. Consequently, an LED traffic light system generally has lower maintenance costs for lighting elements compared with traffic light systems that use incandescent lamps and halogen bulbs.

However, monitoring current supply in an LED traffic light system is difficult because LEDs typically consume less current than electrical lighting elements. Furthermore, detecting the failure of a single LED is not practical for the LED traffic light system. This is because failure of that single LED does not necessarily prevent the remaining LEDs in an LED assembly from continuing to provide a light signal. Hence, existing fault detection techniques applied in traffic light systems using electronic lighting elements and based upon current supply monitoring is difficult and do not reliably detect faults.

Therefore, what is clearly needed is an apparatus that enables improvements in fault detection for traffic lights systems that use electronic lighting elements such as, for example, LEDs.

BRIEF SUMMARY OF THE INVENTION

The present invention seeks to provide an indicator controller, an optical assembly having the indicator controller, a traffic light system that comprises at least one of the optical assembly and a method for fault indication by the indicator controller.

Accordingly, in one aspect, the present invention provides an indicator controller for a traffic light system, the indicator controller comprising:

a control signal generator having at least one control input and a control output; and a power control section having an actuating input and a blocking section, the actuating input being coupled to the control output, the blocking section being coupled to a power control circuit associated with a plurality of electronic lighting elements of the traffic light system.

In another aspect, the present invention provides an optical assembly for providing lighting signals in a traffic light system, the optical assembly comprising:

a plurality of electronic lighting elements;

a power control circuit coupled to the plurality of electronic lighting elements;

a monitoring circuit having a monitoring input and a monitoring output, the monitoring input being coupled to the power control circuit; and an indicator controller comprising:

a control signal generator having at least one control input and a control output; and a power control section having an actuating input and a blocking section, the actuating input being coupled to the control output, the blocking section being coupled to the power control circuit and at least one electronic lighting element of the plurality of electronic lighting elements.

In a further aspect, the present invention provides a traffic light system to provide traffic light signals, the traffic light system comprising:

at least one optical assembly having:

a plurality of electronic lighting elements;

a power control circuit coupled to the plurality of electronic lighting elements;

a monitoring circuit having a monitoring input and a monitoring output, the monitoring input being coupled to the power control circuit; and an indicator controller comprising:

a control signal generator having at least one control input and a control output; and a power control section, having an actuating input and a blocking section, the actuating input being coupled to the control output, the blocking section being coupled to the power control circuit and at least one electronic lighting element of the plurality of electronic lighting elements.

In yet another aspect, the present invention provides a method for fault indication in a traffic light system, the method comprising the steps of:

receiving a comparator input signal when the amplitude of a monitored signal exceeds a predetermined threshold relative to a reference setting;

comparing the comparator input signal with a comparator threshold;

disabling a control signal based upon the comparing step; and blocking current flow through at least one electronic element of a plurality of electronic lighting elements of the traffic light system.

BRIEF DESCRIPTION OF THE DRAWINGS

Preferred embodiments of the present invention are more fully described, by way of example, with reference to the drawings of which.

DETAILED DESCRIPTION OF THE DRAWINGS

An indicator controller, an optical assembly having the indicator controller, a traffic light system that comprises at least one of the optical assembly and a method for fault indication by the indicator controller in accordance with preferred embodiments of the invention are described. In the following description, details are provided to describe the preferred embodiments. It shall be apparent to one skilled in the art, however, that the invention may be practiced without such details. Some of these details may not be described at length so as not to obscure the invention.

There are many advantages of the preferred embodiments of the invention. One advantage of the preferred embodiments is that traffic light systems with electronic lighting elements can be monitored more effectively to detect faults. Using the indicator controller of the preferred embodiments, such faults cause at least one of the electronic lighting elements to blink at a predetermined frequency. Hence, maintenance crews can apply visual inspection to detect the faults.

Another advantage of the preferred embodiments of the invention is that the current supply to an optical assembly can be monitored using an indicator controller that is dedicated to that optical assembly. Therefore, any fault detected by the indicator controller clearly identifies that optical assembly as faulty.

A further advantage of the preferred embodiments of the invention is that the indicator controller can be set to indicate a fault based upon a predetermined number of faulty electronic lighting elements. Hence, there is no need to monitor the current supply to electronic lighting elements individually. Consequently, the indicator controller enables fault detection of the traffic light systems using electronic lighting elements to be practically and variably applied.

Yet another advantage of the preferred embodiments of the invention is that the lighting elements that are used to indicate a fault also serve to provide traffic light signals together with the other lighting elements of the optical assembly. Furthermore, as these other lighting elements are not required to blink when faults are detected, road safety is not compromised for users. This is because such users are not likely to notice or be distracted by a small number of blinking lighting elements relative to a larger number of other lighting elements of the optical assembly.

Figure 1:
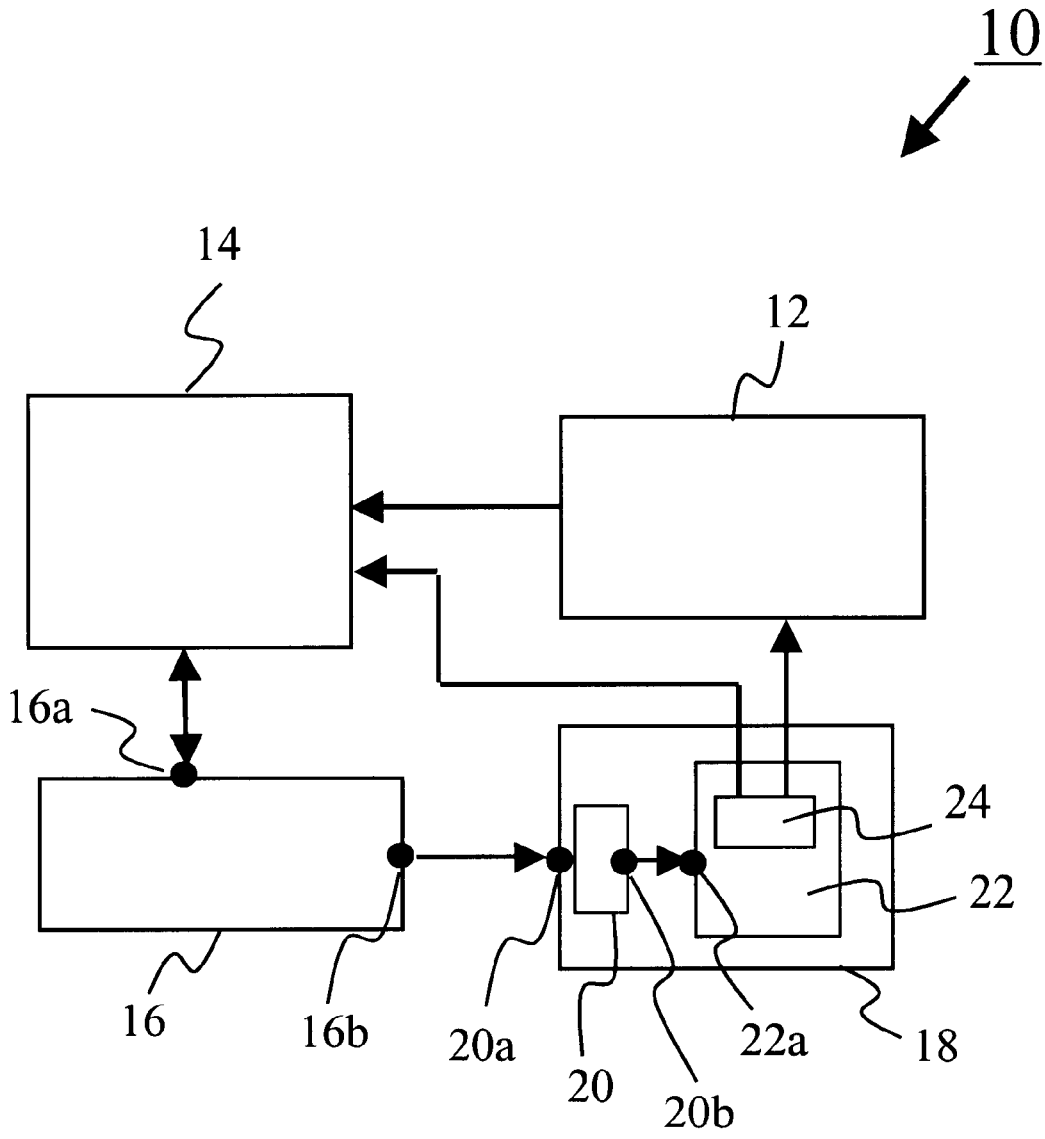
FIG. 1 is a general block diagram of an optical assembly in accordance with a preferred embodiment of the present invention.

Referring now to FIG. 1, a general block diagram of an optical assembly 10 in accordance with a preferred embodiment of the present invention is illustrated. The optical assembly 10 comprises a plurality of electronic lighting elements arranged in an array 12, a power control circuit 14, a monitoring circuit 16 and an indicator controller 18. Collectively, the plurality of electronic lighting elements of the array 12 provides a traffic light signal. The lighting elements can be, for example, light emitting diodes (LEDs).

The power control circuit 14 electrically couples to the array 12 to control supply of electrical power to the plurality of electronic lighting elements. The monitoring circuit 16 has a monitoring input 16*a* and a monitoring output 16*b*. The monitoring input 16*a* couples to the power control circuit 14 to receive a monitored signal. The monitored signal is associated with a current supply to the plurality of electronic light elements 12.

The indicator controller 18 comprises a control signal generator 20 and a power control section 22. The control signal generator 20 has a control input 20*a* and a control output 20*b*. The power control section 22 has an actuating input 22*a* and a blocking section 24. The actuating input 22*a* is coupled to the control output 20*b*. The blocking section 24 is coupled to the power control circuit 14 and at least one of the plurality of electronic lighting elements of the array 12.

Figure 2:
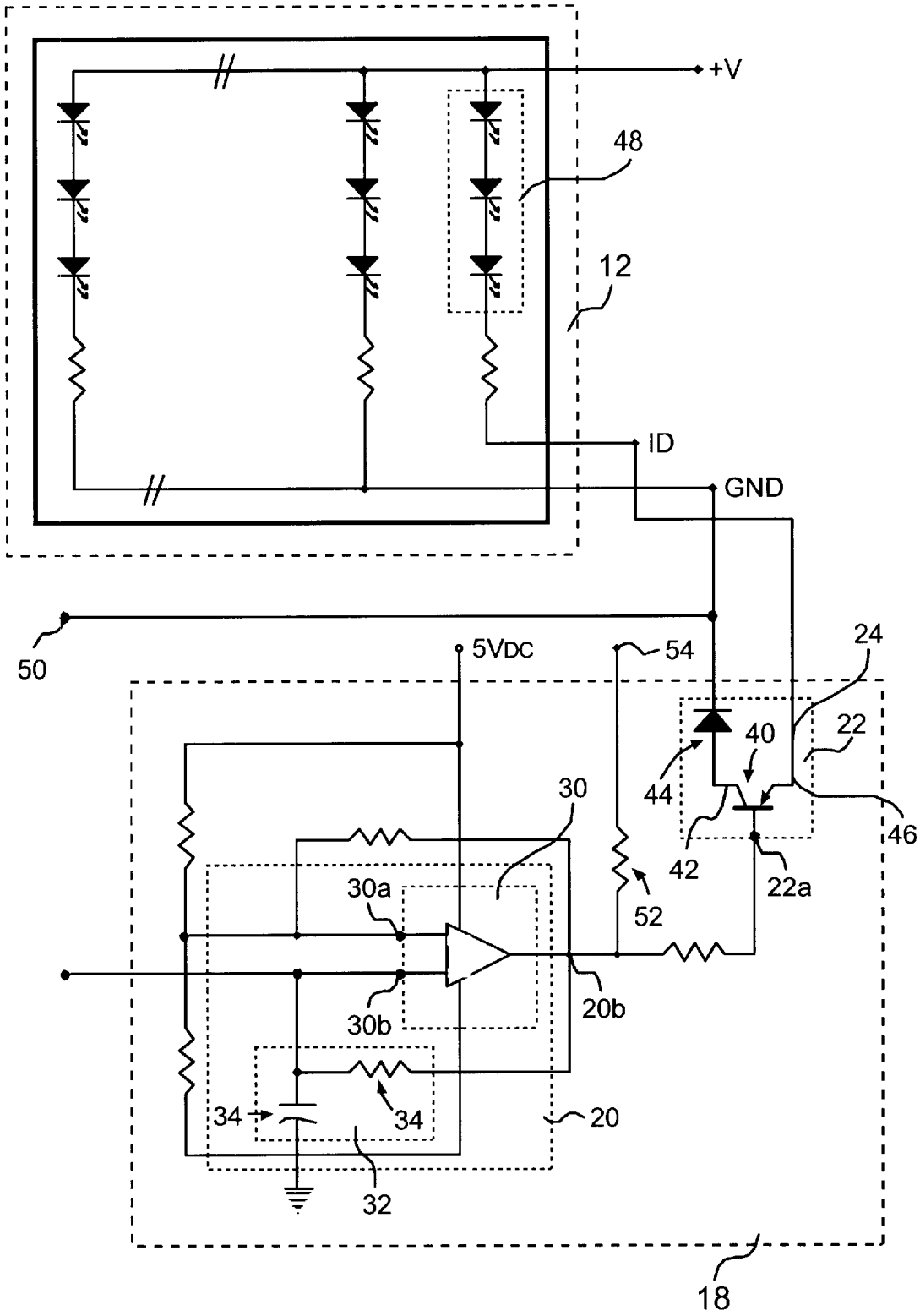
FIG. 2 is a circuit schematic illustrating electrical coupling between an indicator controller and a plurality of electronic lighting elements of the optical assembly of FIG. 1.

A circuit schematic illustrated in FIG. 2 shows electrical coupling between the indicator controller 18 and the plurality of electronic lighting elements of the array 12. Details in the circuit schematic relate to the control signal generator 20 and the power control section 22 of the indicator controller 18.

The control signal generator 20 comprises a comparator 30 having two comparator inputs 30*a*, 30*b* corresponding to the control input 20*a*. The comparator input 30*b* couples to the monitoring output 16*b*. The control signal generator 20 further comprises a frequency setting section 32 coupled to the comparator input 30*b*. A resistor 34 and a capacitor 36 of the frequency setting section 32 provides an RC constant that sets the frequency of a comparator input signal provided at the comparator input 30*b*.

The power control section 22 comprises a transistor 40. This transistor is a pnp transistor but can also be other types of transistors depending on the circuit configuration that is desired for the power control section 22. The base of the transistor 40 provides a control node to serve as the actuating input 22*a*. The collector of the transistor 40 provides an output node 42 that couples to the anode of a diode 44. The emitter of the transistor 40 provides an input node 46 that couples to a diode chain 48 of light emitting diodes of the array 12. The input node 46 provides an electrical node to serve as the blocking section 24.

The cathode of the diode 44 is connected to a common node 50 that is coupled to the cathodes of the LEDs of the array 12 excluding the LEDs of the diode chain 48. However, the diode chain 48 is coupled to the common node 50 via the power control section 22.

In operation, the comparator 30 is set to operate in an open collector mode. In this mode, the transistor 40 is turned on with a control signal at the control output 20*b*. The control signal provides a bias voltage via a pull up resistor 52 connected to a control voltage input 54. When turned on, the transistor 40 enables current to flow through the diode chain 48 and through the transistor to the common node 50. This current is provided when power is supplied to the plurality of lighting elements of the array 12 for a traffic light signal. However, when the transistor 40 is turned off, conduction of the current through the transistor 40 to the common node 50 is blocked. Hence, the LEDs of the diode chain 48 are not powered on in such a situation even when the other LEDs of the array 12 are powered on to provide the traffic light signal.

Figure 3:
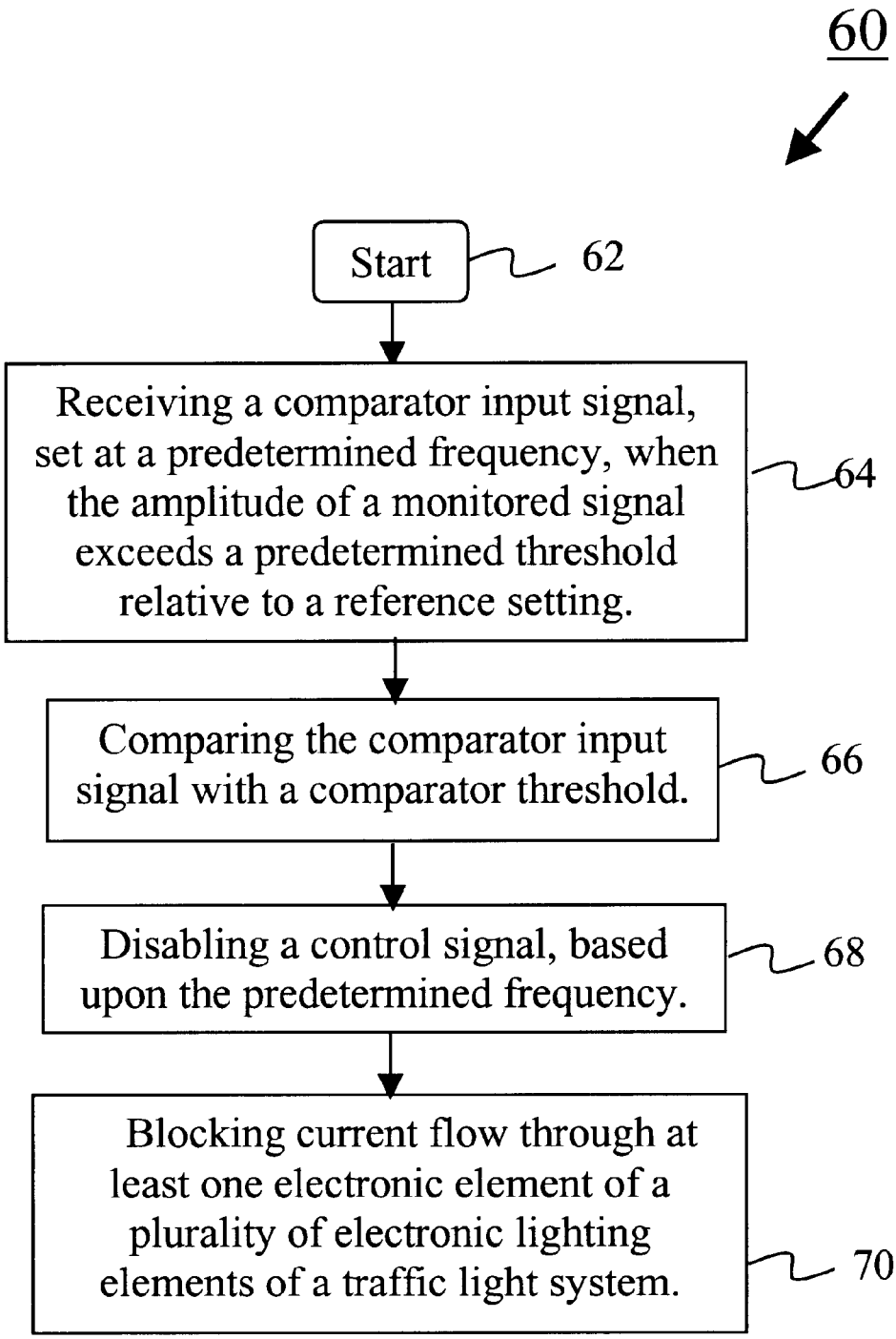
FIG. 3 is a flowchart of a method for fault indication by the indicator controller of FIG. 2.

A traffic light system (not shown) to provide traffic light signals can be implemented using at least one of the optical assembly 10. Accordingly, each optical assembly 10 provides each of the traffic light signals. A method 60 for fault indication in such a traffic light system by the indicator controller 18 is described using the flowchart as illustrated in FIG. 3.

The method starts at step 62 and continues to step 64 at which a comparator input signal is received at the comparator input 30*b*. The monitoring circuit 16 generates the comparator input signal when the amplitude of the monitored signal exceeds a threshold relative to a reference setting. The reference setting can be, for example, a reference voltage. The monitored signal then provides a measured voltage, based upon the current supply to the plurality of electronic lighting elements, that is compared with the reference voltage.

Thereafter, at step 66, the comparator input signal is compared with a comparator threshold provided at the comparator input 30*a* using the comparator 30. When the comparator input signal and the comparator threshold have substantially the same amplitude, the control signal at the control output 20*b* is disabled at step 68. As the frequency setting section 32 sets a predetermined frequency at which the comparator input signal is received at the comparator input 30*b*, the control signal is intermittently disabled at that predetermined frequency.

Intermittently disabling the control signal therefore switches the transistor 40 on and off. This therefore blocks current flowing through the transistor 40 at step 70 according to the predetermined frequency. Consequently, the LEDs of the diode chain 48 turns on and turns off at the predetermined frequency. Visually, this turning off and turning on of the LEDs has the effect of such LEDs blinking or flashing.

The present invention therefore provides an indicator controller 18, an optical assembly 10 having the indicator controller, a traffic light system that comprises at least one of the optical assembly 10 and a method for fault indication by the indicator controller

What is claimed is:

1. A method for fault indication in a traffic light system by an indicator controller, said method comprising the steps of:

receiving a comparator input signal when the amplitude of a monitored signal exceeds a predetermined threshold relative to a reference setting;

comparing said comparator input signal with a comparator threshold;

disabling a control signal based upon said comparing step; and blocking current flow through at least one electronic element of a plurality of electronic lighting elements of said traffic light system.

2. The method as claimed in claim 1, wherein said receiving step comprises the step of setting a predetermined frequency for said comparator input signal.

3. The method as claimed in claim 2, wherein said disabling step comprises the step of disabling said control signal based upon said predetermined frequency.

4. The method as claimed in claim 1, wherein said blocking step comprises the step of blocking said current flow from said at least one electronic element to a common node.

* * * * *